United States Patent [19]

Dingess

[11] Patent Number: 4,747,503

[45] Date of Patent: May 31, 1988

[54] TAMPER RESISTANT DRUG CONTAINER

[76] Inventor: Billy E. Dingess, P.O. Box 357, Ferrellsburg, W. Va. 25513

[21] Appl. No.: 835,949

[22] Filed: Mar. 4, 1986

[51] Int. Cl.[4] ..... B65D 55/02

[52] U.S. Cl. ..... 215/366; 206/807

[58] Field of Search ..... 215/366, 365, 367, 230; 206/807, 221, 459

[56] References Cited

U.S. PATENT DOCUMENTS

| | | | |
|---|---|---|---|
| 576,805 | 2/1897 | Campbell | 215/365 |
| 917,665 | 4/1909 | Sanders | 215/366 |
| 1,072,139 | 9/1913 | McGuire | 215/366 |
| 4,453,636 | 6/1984 | Meadows et al. | 215/366 X |

*Primary Examiner*—Donald F. Norton

[57] ABSTRACT

A means of packaging drugs and the like is described comprising a container, having two compartments, one of which is to leave evidence that the container has been previously opened by attaching a plunger to link up with the lower compartment by way of a tip being inserted into the lower compartment and when the cap is removed, said tip will be separated for the plunger releasing a dye along with the tip to remain in said lower compartment, making it necessary to destroy the lower compartment to remove said tip or dye that said drugs and the like can be stored in the upper compartment, making a sure and visible way for packaging, making it known to the consumer should the container have been previously opened.

5 Claims, 1 Drawing Sheet

TAMPER RESISTANT DRUG CONTAINER

BRIEF SUMMARY OF THE INVENTION

The dangers of drugs being tampered with has been made known many times and with two or three seals that must be broken, it seems or appears that a person can break into and replace the seals to a point, whereby, it is not noticed. The purposed invention will show a visual change in the container that cannot be assembled other than replacing it with a new bottle to where a person will have no problem as to if the bottle has been opened or not.

DETAILED DESCRIPTIONS

Figure 1:
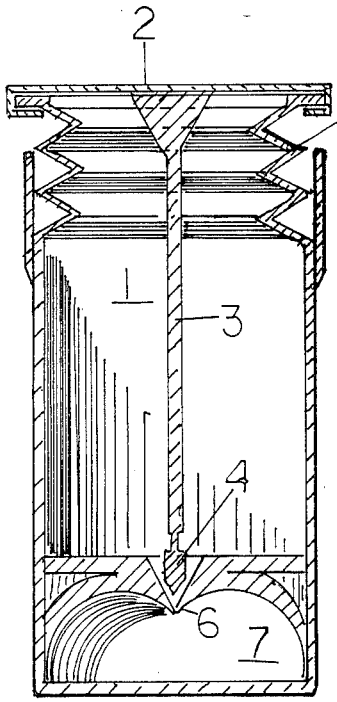
FIG. 1 shows a bottle and cap with a needle like plunger, before cap bellows is compressed.
Figure 2:
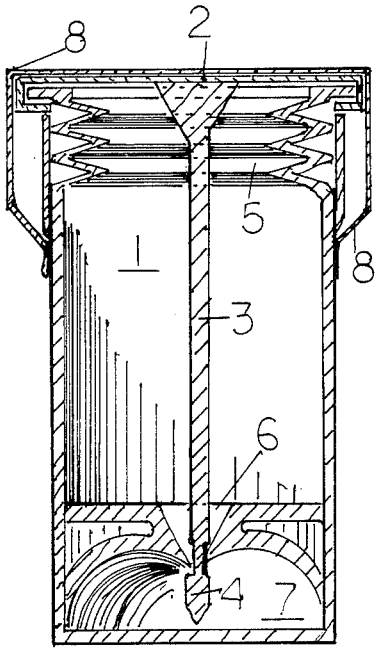
FIG. 2. shows the bottle ready for sale after bottle is closed with bellows collapsed, with plunger inserted into an opening at the bottom where second compartment is housed on the bottle.
Figure 3:
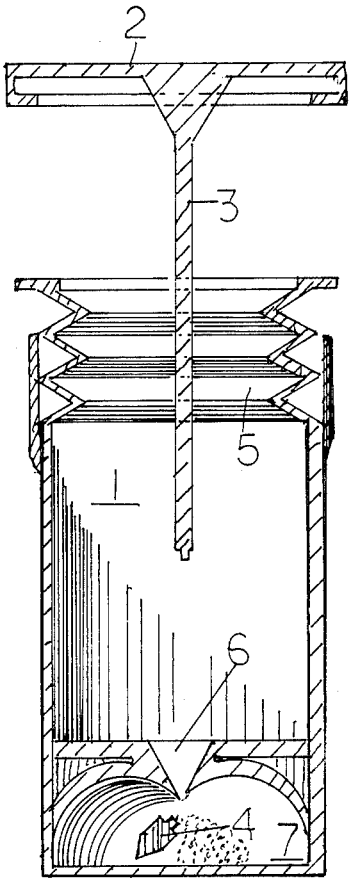
FIG. 3. shows what happens when the cap is removed from the bottle.

In the drawings is shown a container 1 housing a second compartment 7 at the bottom of container 1 along with a spring like bellows 5 neck where a cap 2 can be attached thereunto, said cap housing a plunger 3. When the cap 2 is installed, the bellows 5 must be collapsed to link plunger tip 4 with a hole 6 that is designed to allow the plunger tip 4 to pass through said hole but will not allow the plunger tip 4 to be pulled in the opposite direction without breaking the small portion of the plunger 3 leaving said plunger tip 4 inside the lower compartment. The plunger tip 4 can be filled with a dye that would be released inside lower compartment 7, which will discolor the lower compartment 7, and this dye along with plunger tip 4 cannot be removed without destruction of said compartment 7. When the cap 2 is removed from container 1, a reasonable hard pull must be made that will separate the plunger 3 from the plunger tip 4. Should a person remove cap 2 from container 7 without said pull, it should be assumed that the container has been tampered with, however, the bellows 5 will extend to its original position before cap 2 was installed being held collapsed by the plunger tip 4, said tip being linked to lower compartment 7, the pull on cap 2 will break or cut the plunger tip 4 from the plunger 3 leaving the tip 4 inside lower compartment 7, thereby, releasing the dye housed in plunger tip 4 into the lower compartment 7.

A person can assume that the container has been previously opened if the seal 8 is removed.

There is no pull required when cap 2 is removed.

The bellows neck is extended, the plunger tip is lying in the bottom of the lower compartment, and said lower compartment 7 is discolored.

It should be noted that the present invention provides a tamper resistant container that can be manufactured economically as well as possess good production capabilities for mass production, since many possible embodiments may be made of the invention without departing from the scope thereof; it is to be understood that all matters herein set forth or shown in the accompanying drawings are to be interpreted in an illustrative and not in a limiting sense.

What is claimed is:

1. A tamper resistant drug container comprising in combination;

a drug compartment, said drug compartment further comprising;

a spring like bellows neck, said neck comprising linkage for a cap;

a separate compartment at the lower portion of said container, said separate compartment further comprising a bottom for said compartment, said bottom having a hole through the center of said bottom, said hole forming a funnel shaped passage from within said drug compartment to within said separate compartment;

a cap, said cap further comprising linkage for said container neck;

a plunger beginning at the inner center of said cap having a smaller portion linking a dye filled tip at said plungers opposite end and said combination further comprising means for linking said tip by way of said cap to and within said separate compartment by way of said hole.

2. A drug container as claimed in claim 1 wherein said passage further comprises means for allowing said tip to pass through to within said separate compartment and said passage further comprising;

a means for braking or cutting said smaller portion of said plunger when said plunger is pulled in the opposite direction, thereby cutting said tip and permanently housing said tip within said separate compartment.

3. A drug container as claimed in claim 1 comprising means for connecting said cap plunger tip within said separate compartment by collapsing said container bellows neck until said tip links within said separate compartment to hold said bellows neck collapsed to where a seal of conventional type can be installed around said cap.

4. A drug container as claimed in claim 1 further comprising means for separating said tip from said plunger by pulling said cap off said container, said pull causing said opening to said lower compartment to wedge against said smaller portion of said plunger, thus cutting said plunger tip from said plunger housing said tip within said separate compartment.

5. A drug container as claimed in claim 1 further comprising means for releasing a liquid dye along with said plunger tip within said separate compartment for the purpose of revealing evidence that said container cap has previously been removed from said container;

a compartment within said plunger tip provided with a liquid dye, said compartment linked by way of the smaller portion of said plunger, whereby when said plunger is cut by removing said cap thus releasing said tip within said separate compartment, a portion of said dye will be released from said plunger tip, thereby staining a portion of said separate compartment and thus making it necessary to destroy said separate compartment to remove said tip and said dye, thus providing positive evidence that said cap has previously been removed from said container.

* * * * *